US005829671A

United States Patent [19]

Hawk

[11] Patent Number: 5,829,671

[45] Date of Patent: Nov. 3, 1998

[54] PET LITTER SCOOP

[76] Inventor: Richard B. Hawk, 5906 Shortleaf Ct., St. Louis, Mo. 63128

[21] Appl. No.: 840,991

[22] Filed: Apr. 22, 1997

Related U.S. Application Data

[60] Provisional application No. 60/016,355 Apr. 26, 1996.

[51] Int. Cl. [6] ..... B65D 5/00

[52] U.S. Cl. ..... 229/103; 294/1.3; 229/138; 229/125.03; 229/125.08

[58] Field of Search ..... 229/103, 138, 229/112, 117.03, 101.1, 400, 401, 125.03, 125.04, 128.08, 125.09, 125.05, 125.19; 220/908; 294/1.3

[56] References Cited

U.S. PATENT DOCUMENTS

| | | | |
|---|---|---|---|
| 3,639,937 | 2/1972 | Sweeney | 294/1.3 |
| 3,685,088 | 8/1972 | Doherty | 294/1.3 |
| 3,877,632 | 4/1975 | Steel | 229/117.03 X |
| 3,971,503 | 7/1976 | Allan et al. | 229/38 |
| 4,017,015 | 4/1977 | Jefferson | 229/19 |
| 4,185,764 | 1/1980 | Cote | 229/117.03 |
| 4,267,955 | 5/1981 | Struble | 229/117.03 |
| 4,380,289 | 4/1983 | Bigelow | 220/410 X |
| 4,747,633 | 5/1988 | Stacy | 294/1.3 |
| 5,301,870 | 4/1994 | Smith et al. | 229/1.5 B |
| 5,522,628 | 6/1996 | Fillis | 294/1.3 |
| 5,564,762 | 10/1996 | Ring | 294/1.3 |

*Primary Examiner*—Allan N. Shoap
*Assistant Examiner*—Tri M. Mai
*Attorney, Agent, or Firm*—Paul M. Denk

[57] ABSTRACT

A carton functioning as a pet litter scoop, formed as a carton having a front, back, and a pair of side walls, a bottom closure for the carton, a scoop flange securing proximate the upper edge of the back wall, a pair of gussets formed between the scoop flange and the upper edges of the carton side walls, said scoop flange and gussets securing interiorly proximate the upper edge of the carton, a lid, with closure flap, pivotally connecting to the upper edge of the back wall, and when folded over holding the carton and its scoop flange into closure, a pair of lateral flaps extending from the sides of the lid, and a pair of side flanges extending from the upper edges of the side walls, all cooperating to either hold the scoop flange into its functional position, or to secure the carton into closure.

7 Claims, 7 Drawing Sheets

PET LITTER SCOOP

CROSS-REFERENCE TO RELATED APPLICATION

This application claims the benefit under Title 35, U.S.C. §120, and other provisions of the Code of the pending provisional patent application filed under Ser. No. 60/016,355, filed on Apr. 26, 1996.

BACKGROUND OF THE INVENTION

The principle object of this invention is to provide a easily assembled, conveniently usable, and readily disposable paper or paperboard container that may be utilized as a pet scoop for disposing of the litter generated from pets.

In the prior art, a variety of various types of scoops, whether it be similar to small strainers, miniaturized shovels, handled scoops, flattened spoons, or the like, have been designed, commercialized, and marketed through the pet industry to the owners of primarily domestic pets in the category of dogs, cats, or the like. The purpose of these scoops, obviously, is to provide a more sanitary way to dispose of the pet's litter, whether it be excrement, hair balls from the cat, or related types of disposable waste, to facilitate their convenient removal, without excessive contact or exposure of the pet owner to such normally highly contaminatable waste material. The problem with the prior art type of means for disposal of such waste is that while it is advantageous to allow for the initial recovery and pick up of such waste, the homeowner then has the problem of finding some surplus receptacle, whether it be a plastic bag, newspaper, napkin, or even a container, in which to place it, and store it, until such time as the trash is taken outside for pickup by the hauler. Thus, there is a need for an integrated device that affords all of these attributes during usage and application, so as to minimize, if not totally eliminate, the pet owner's exposure to such infectious waste.

SUMMARY OF THE INVENTION

It is the principal object of this invention to provide a foldable carton, which may be assembled at a plant, shipped in a collapsed state, marketed in such a capacity, and then easily erected by the home and pet owner, just prior to its usage and application, for sanitary disposal of solid pet waste of any type.

This invention contemplates the formation of a carton, usually formed of paperboard, and which may be cut from a blank of material, scored and/or provided with fold lines, and which may be manipulated into the configuration of a rectangular or square small carton, by the user, for disposal of the aforesaid type of waste. Generally, the carton is fabricated to the design of a rectangular carton, usually of a shape and size to provide for its convenient grasping and holding by the hand, during its application, so as to provide for its facile manipulation into a position where waste may be scooped up, and then enclosed within the carton, for ready disposal, and minimize the exposure of the surrounding environment to such infectious waste, as can be understood.

The carton is formed having a series of front, back, and side walls, which are folded into the usual tubular form. The bottom of the carton includes a series of flaps, that may be folded into a position of closure, when the carton is erected for usage, to provide a stable base for retention of any deposited waste, during the carton's usage, and when discarded.

The top end of the carton includes a separately applied scoop-like member, formed integrally containing arranged lateral gussets, and which can be erected into a scoop configuration, when the carton is used, to provide for easy scraping of such waste into its interior, during application. This gusseted scoop-like member may be a separate component, and easily assembled into the carton structure, during its fabrication.

The carton lid and closure structure is integrally formed within the carton blank, during its fabrication, and includes a pair of lateral flaps, that may be initially folded inwardly against the gusseted portions of the carton scoop, to provide a noncontacting method for initial closure of the scoop, and for retention of the waste deposited within the carton, and subsequently, the integral carton lid may then be folded over, and tucked into closure, through the application of its usual closure flap. When such is achieved, the entire paperboard container provides a secure means for completely enclosing the waste disposed therein, and the carton can now be thrown into the trash, for convenient and nonleakage disposal. The contained waste is totally isolated from the carton exterior.

Such a pet litter scoop carton has extensive practicality even outside of the home or residence, particularly where antilitter laws are in effect in various municipalities that require the pet owner to immediately dispose of any waste deposited by their dog, cat, or other pet, regardless that such may occur even off of the owner's premises. In addition, a carton of this invention can also conveniently be utilized at commercial establishments such as at kennels, veterinary offices and hospitals, and related establishments. Obviously, any type of indicia may be imprinted upon the exterior surface of the carton, also to provide for advertising purposes.

It is, therefore, the principal object of this invention is to provide a foldable carton that can be conveniently erected into a pet litter scoop, for use by the pet owner for the removal of waste.

Another object of this invention is to provide a carton that is structured for convenient manipulation, by the pet owner, during the assembly, usage and disposal of the waste laden container.

A further object of this invention is to provide a foldable carton including various convenient scoop-like means, which may be formed of gussets, to facilitate the initial pickup of animal waste.

Still another object of this invention is to provide a litter scoop wherein its gusseted scoop portion may be separately formed and applied to a carton, or it may be integrally formed into and of the same carton blank.

Yet another object of this invention is to provide a carton incorporating various flanges that facilitate the convenient closure of the carton's scoop-like portion to allow for the secure containment of animal waste, after pickup.

Still another object of this invention is to provide an inexpensively formed carton that may be conveniently disposed of, when applied as a pet litter scoop.

These and other objects will become more apparent to those skilled in the art upon reviewing this summary of the invention, in addition to the description of the preferred embodiment herein.

BRIEF DESCRIPTION OF THE DRAWINGS

In referring to the drawings.

FIG. 8A discloses the blank for the carton; while FIG. 8B shows the separate gusseted scoop as it is manipulated into engagement and retention at the upper end of the carton blank during its assembly.

DESCRIPTION OF THE PREFERRED EMBODIMENT

Figure 1:
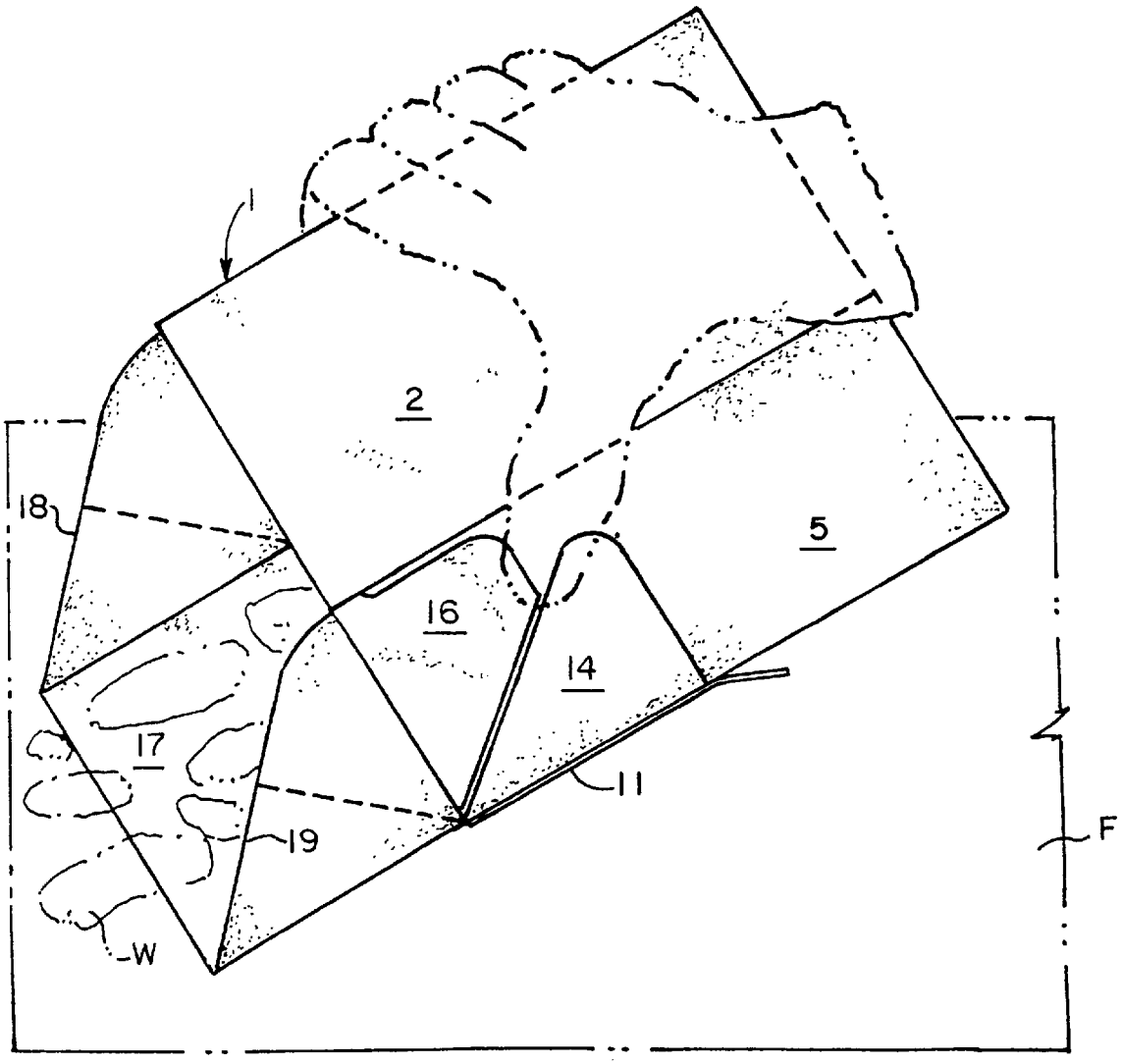
FIG. 1 is an isometric view of the pet litter scoop of this invention during its application and usage.

In referring to the drawings, and in particular FIG. 1, the concept of this invention shown in its usable form is in the process of being applied, for use for picking up waste material W, from a floor, carpeting, lawn F, or the like. The carton 1 is formed of paperboard, usually of the thinner and more pliable type, and includes, in referring to FIG. 8A, a front wall 2, a back wall 3 and a pair of side walls 4 and 5. A manufacturer's joint or glue flap 6 is provided along the side of one of the walls, being the side wall 4, as noted, and is adhesively applied to the edge of the front wall 2, to provide the tubular form for the carton during its assembly. Securing to the bottom edge of each of the walls are a series of flanges 7 through 10, and which can be folded over into closure, and either held by force into closure, or adhesively glued into position, to form a reasonably tight bottom for the carton, so as to prevent the escape of any waste, once it is deposited therein. Any type of bottom closure, as known in the art, may be assembled into this carton structure, to afford this type of seal thereat. See FIGS. 6 and 7.

At the upper edge of the carton blank is provided a foldable lid 11, which includes a closure flap 12, so that when the lid is folded over into closure, the closure flap can be tucked into the interior of the carton, to provide for complete closure at the upper end of the carton, in preparation for its disposal. As can also be seen, there are a pair of lateral flaps 13 and 14, arranged integrally adjacent the lid 11, and these flaps, as will be subsequently described, are applied adjacent the sides of the carton during usage of its scoop, to retain the components into their usable configuration, generally as can be seen in FIG. 1. In addition, there are a pair of force flaps 15 and 16 foldably connected to the upper edges of the side walls 4 and 5, and these flaps are also retained adjacent the sides of the carton, during its usage, as can be seen in FIG. 1, but are folded over to force the gusset into closure, after usage of the carton, as can be noted in FIG. 2.

Figures 8A, 8B:
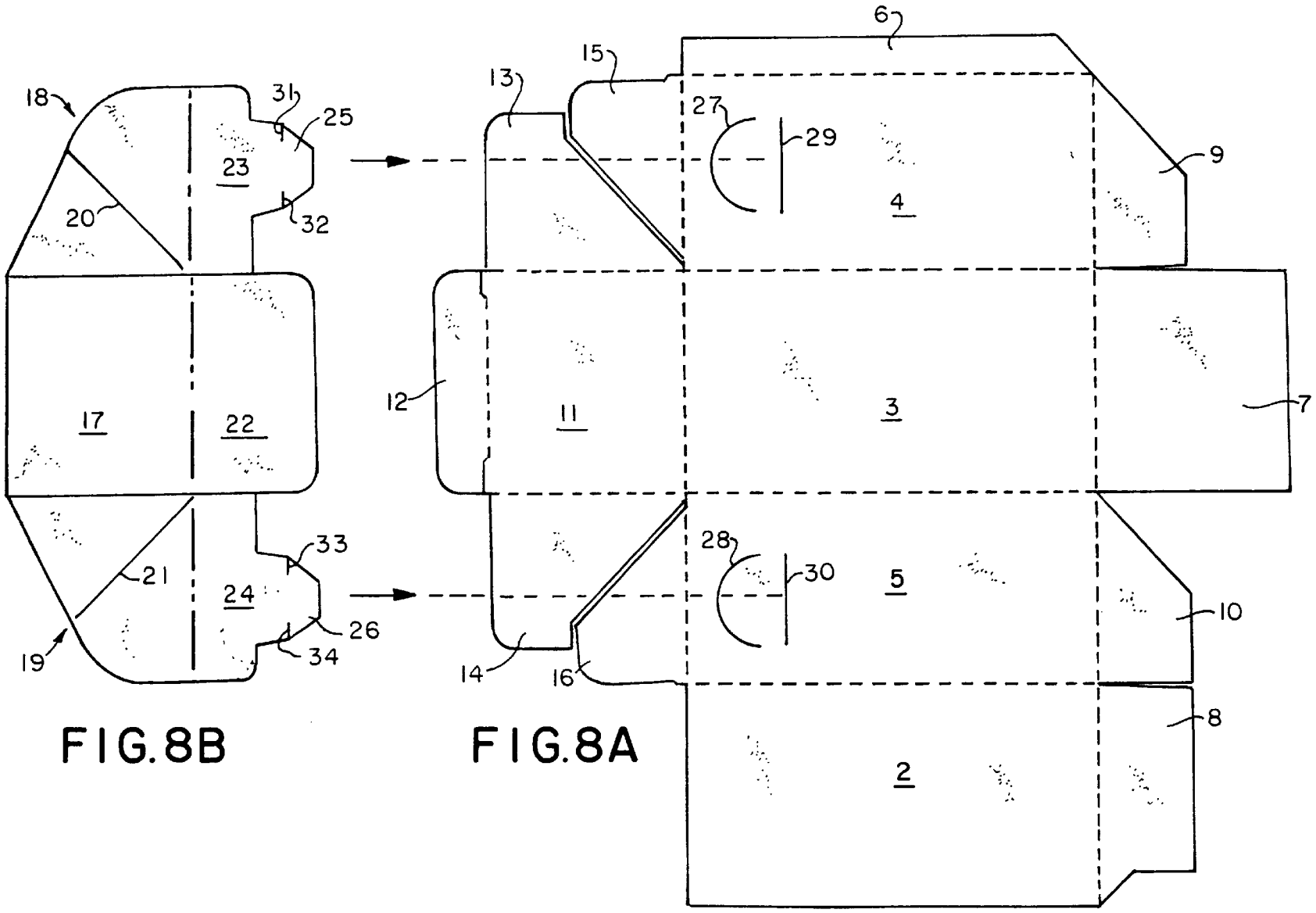

As can be seen in FIG. 8B, the configuration of the scoop, in the blank form, is disclosed. As shown, the scoop includes a scoop flange 17, which includes a pair of gussets 18 and 19, integrally and foldably connected therewith, with each gusset having a centralized arranged fold line 20 and 21 to provide for collapse and closure of the scoop flange 17, after its usage. But, during usage of the pet litter scoop, as can be seen in FIG. 1, the gussets 18 and 19 are extended, as noted, to dispose the scoop flange 17 into position for usage for pickup and disposal of the shown waste. The scoop flange 17 has foldably connected therewith a base flange 22, and foldably connected to either side, and also foldably connected to their respective gussets 18 and 19, are the interlocking flanges 23 and 24. Each of the interlocking flanges 23 and 24 have extending tabs 25 and 26 which are designed for inserting through the arcuate slots 27 and 28, respectively, formed within the side walls 4 and 5, and then their interlocking tabs 25 and 26 insert into the linear slots 29 and 30 and become engaged therein, to retain the scoop interconnected with the carton, during its assembly, while folded, and when erected into its usable condition. The inwardly extending slits 31 through 34 engage within the inner edge of the lineal slots 29 and 30, when inserted therein, to provide for a reasonable interlock and retention of the scoop after its attachment with the carton. When this occurs, the positioning flap 22 will rest contiguously against the upper interior surface of the back wall 3 of the carton, when assembled.

Figure 6:
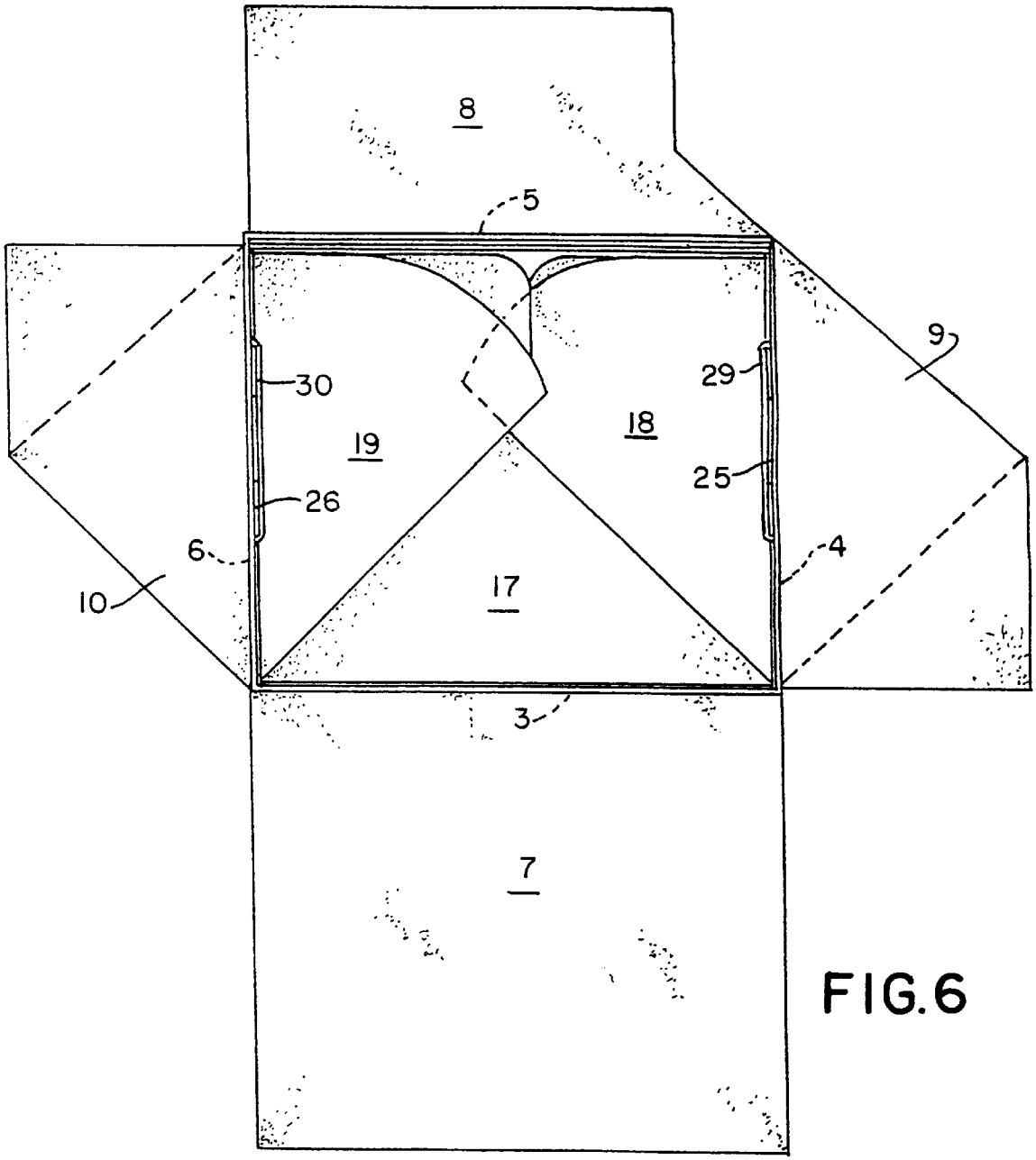
FIG. 6 shows the bottom flanges during process of their being folded into closure.
Figure 7:
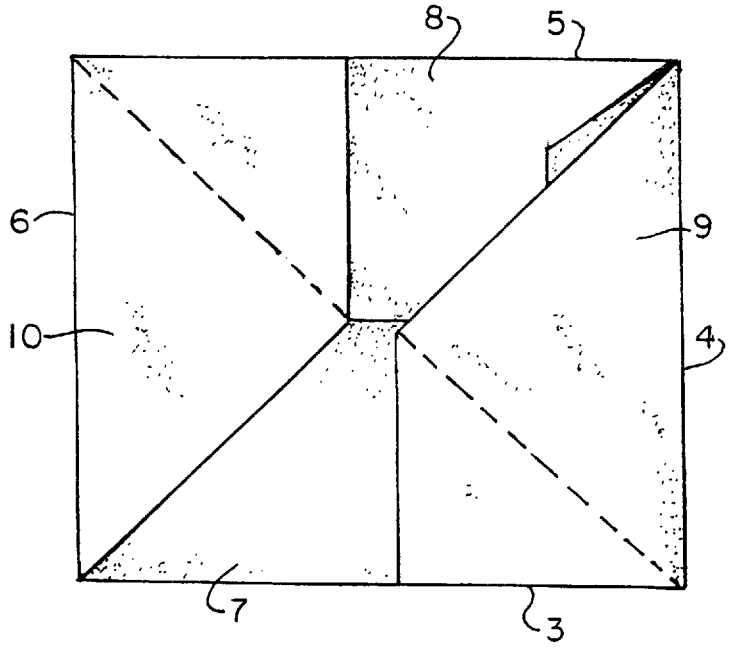
FIG. 7 discloses the bottom flanges folded into closure.

As can be seen in FIGS. 6 and 7, the various flaps 7 through 10 that form the bottom wall for the container are disclosed. When these flaps are folded over into closure, and secured at that position, they form a complete closure for the bottom of the container, as noted in FIG. 7. Usually, the flap 7 is folded over first, and then the opposite flap 8 is arranged into closure, while the two side flaps 9 and 10 are then folded over, and adhesively held against the underlying flaps. Obviously, other types of securement can be made for holding the bottom assembled, with its flaps closed, as for example, a closure tab (not shown) may be attached to the outer edge of the bottom flap 7, and then engaged through a slot provided through and along the fold line between the bottom flap 8, and its front panel 5. This is just an example as to how the bottom flaps may be secured together, without the use of an adhesive.

As can also be seen in FIG. 6, when the top flaps and flanges are closed, their relationship interiorly of the carton, when closed, is likewise shown. Also, the inwardly extending tabs 25 and 26, through the slits 29 and 30, can also be seen interiorly of the carton.

Figure 2:
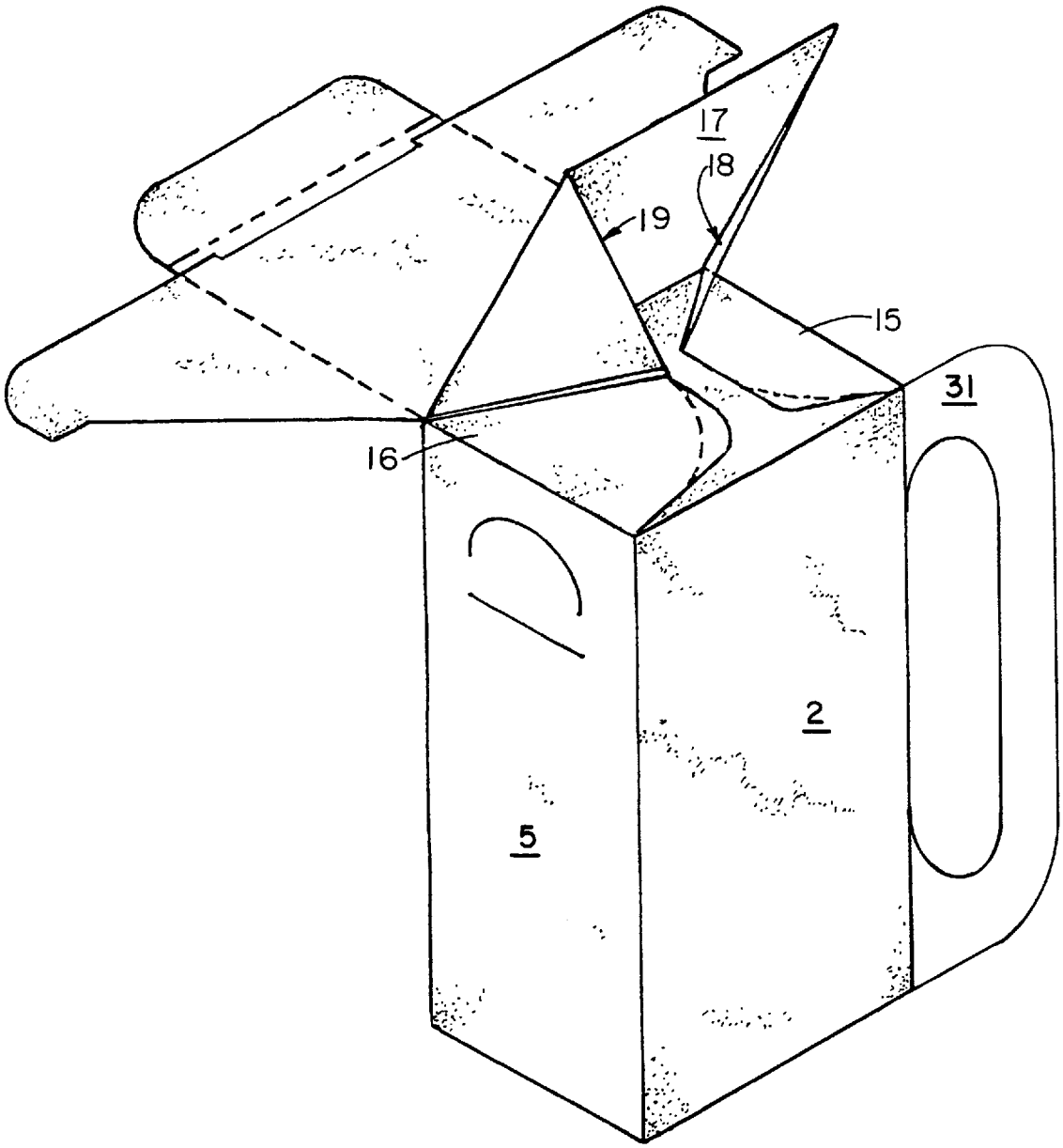
FIG. 2 is an isometric view disclosing the integral lid and gusseted scoop for the carton, during its folding into a usable position.
Figure 3:
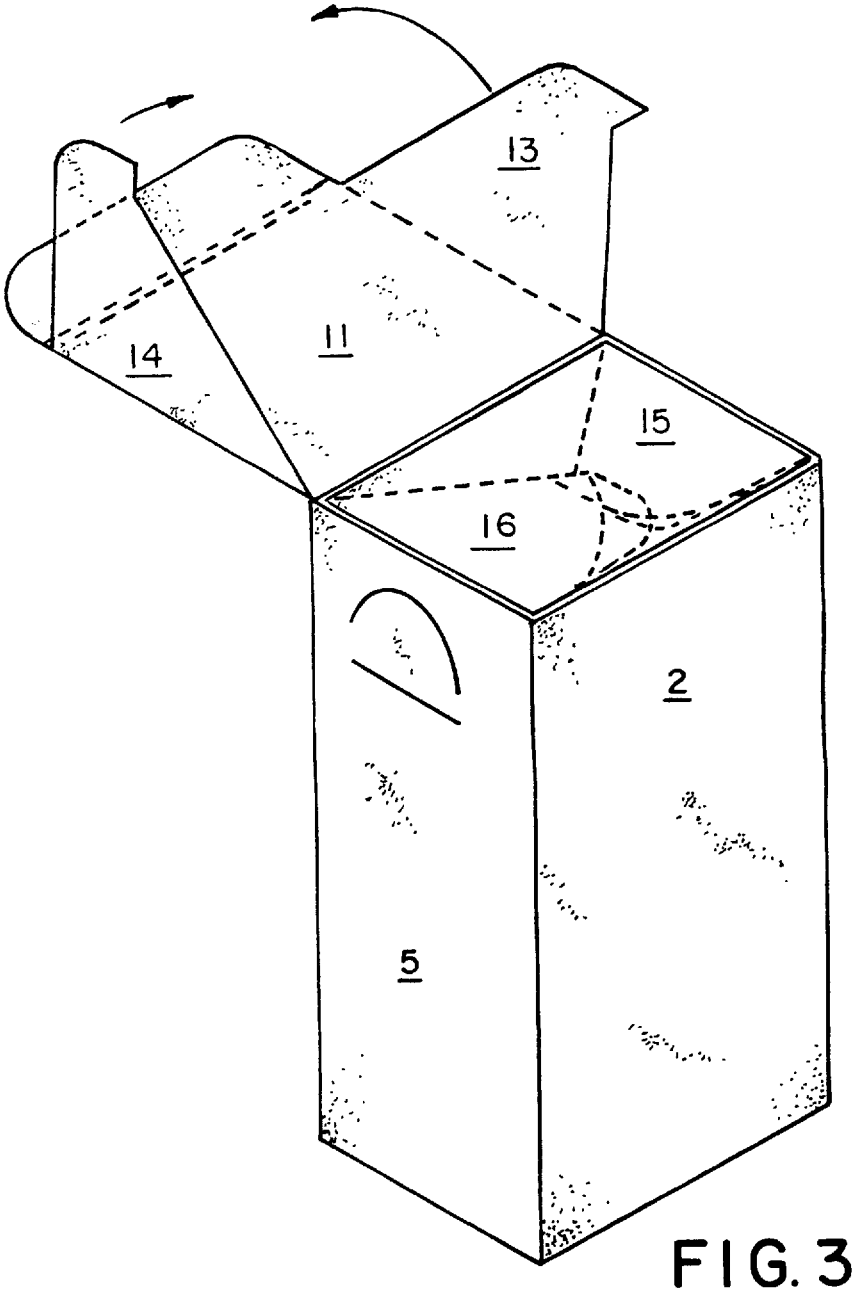
FIG. 3 shows the application of the fold flanges of the carton forcing the gusseted scoop into closure.

When the carton is used, the sequence of its application can be seen from FIGS. 2 through 5. Initially, as the carton is being set up for usage, and when folded into the tubular form, for application, such can be noted in FIG. 1. When in that position, the scoop's panel 17 extends forwardly of the carton, and its gussets are expanded, as can be noted at 18 and 19. The panels 13 and 14, for holding the top panel 11 flush against the back wall of the container, are held flush against the outside of the side walls 4 and 6. The front panel 5 extends upwardly, as noted. In addition, the force flanges 15 and 16 are bent downwardly, and likewise held by the hand of the user, during application of the pet litter scoop. Once all the waste material W has been scooped up, then, as can be seen in FIG. 2, the force flanges 15 and 16 are folded upwardly, and push against the panels of the gussets 18 and 19, to force them into closure, and to pull scoop panel 17 downwardly, against the top of the container, as shown. At this time, as can be seen in FIG. 3, the positioning flanges 13 and 14 are folded over, to the underside of the top panel 11, as can be noted in FIG. 4. Then, the top panel 11 is folded over, and its closure flap 12 is tucked in interiorly of the container front wall 5, to secure the container into closure. At this time, the carton, as can be seen, is fully enclosed, containing all the waste material therein, which prevents their escape from any area from within the carton, and thereby allowing the enclosed carton to be disposed of, in the waste basket, trash bin, or the like.

Figure 4:
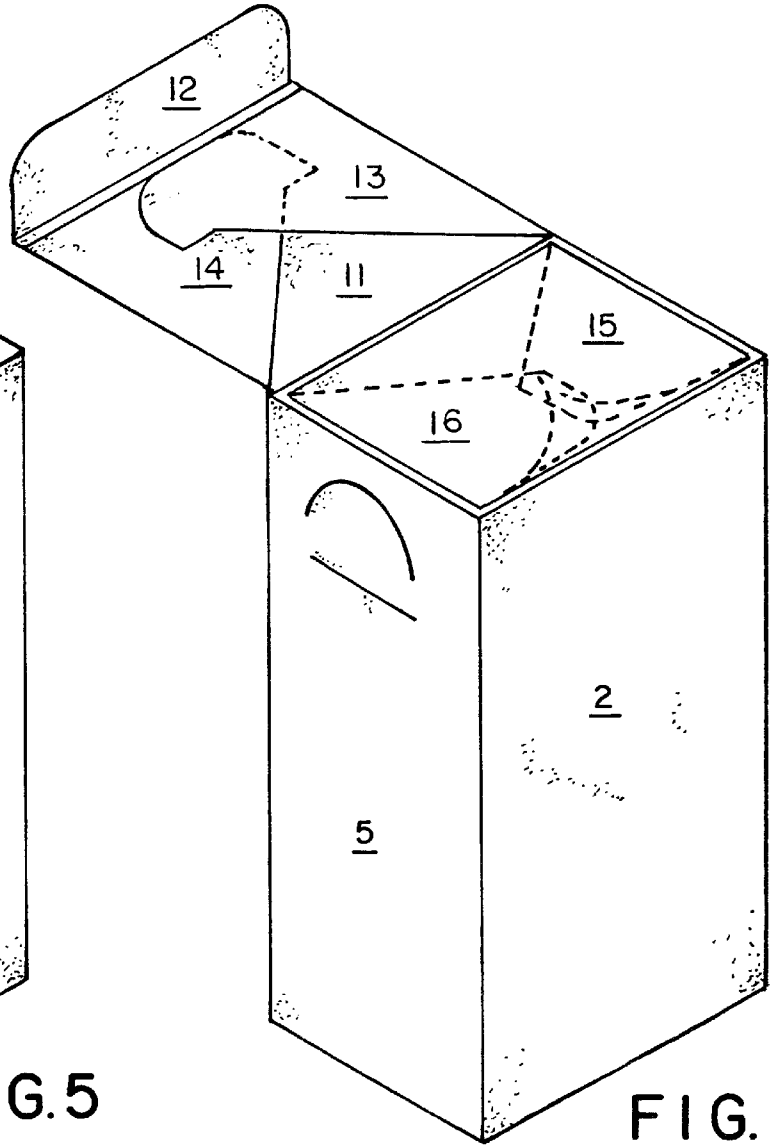
FIG. 4 shows the side flanges of the lid folded over into closure in preparation for the lid's engagement into closure.
Figure 5:
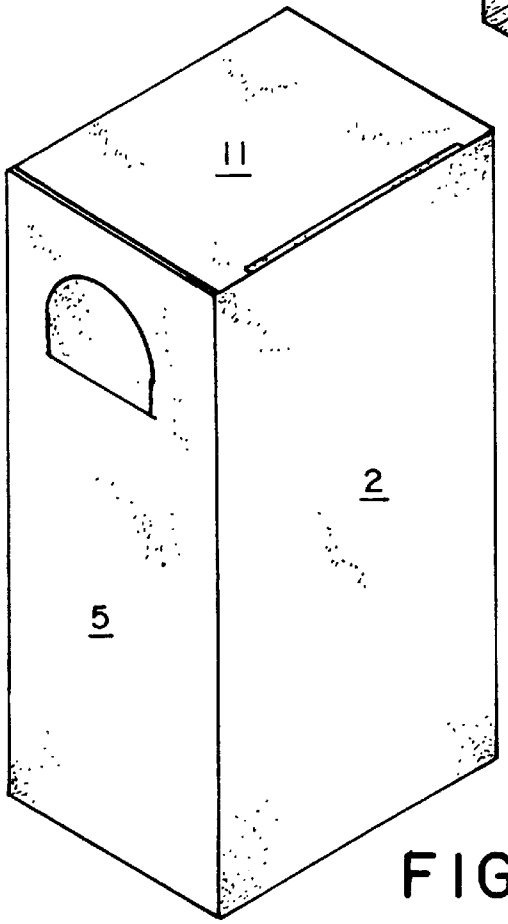
FIG. 5 shows the lid of the carton engaged into closure.

As an abbreviated version of the carton of this invention, it is possible that a carton, of the general configuration as shown in FIG. 8A, may likewise be formed containing the usual front, back and side walls, and bottom closure panels. But, extending from the back wall 3 may be foldable lid 11, in addition to having its closure flap 12 foldably connected thereto. But, instead of utilizing the various flanges 13 through 16, it may be possible that gussets, such as 18 and 19, may be integrated into the modified blank of said figure, so that the gussets integrate and fit directly between the lid 11, at its sides, and the upper edges of the side panels 4 and 5. In this manner, the lid 11 becomes the scoop, having gussets to either side, and when it has been utilized to pick up any waste material, the gussets 18 and 19 may be simply forced inwardly, thereby allowing the lid 11 to buckle over, and folded over into closure, in the manner as shown in FIG. 4, with its closure flap 12 tucking in at the upper interior edge of the front wall 2, to hold the waste laden container in closure. This is just a modification thereto.

As can also be noted from FIG. 2, optionally, a handle 31 may connect with the edge of the front wall 2, and provide a handle means for use for conveying of the scoop, once animal waste has been deposited into its carton.

Variations or modifications to the subject matter of this invention may occur to those skilled in the art upon reviewing the disclosure of the invention herein. Such variations or modifications, are intended to be encompassed within the spirit and scope of the invention as described herein. The description of the preferred embodiment set forth in this application is done so for illustrative purposes only.

Having thus described the invention, what is claimed and desired to be secured by Letters Patent is:

1. A carton for functioning as a pet litter scoop, comprising a carton having a top and formed having a front wall, back wall, and a pair of side walls, and a bottom closure, all formed together along fold lines to facilitate its folding into the carton form, said side walls having top edges, and said back wall having an upper end, a scoop flange foldably associated with the upper end of the back wall by a pair of flaps attached to said side walls, a pair of integral gussets formed adjacent each side edge of the scoop flange and connecting to the top edge of the proximate side wall, the gussets and the scoop flange when extended functioning as a scoop to facilitate the movement of pet waste thereon and its disposition into the carton for its disposal, said scoop flange capable of folding over into closure to close the top of the carton while the gussets fold into the carton during closure, said flaps foldably connecting and extending downwardly from the scoop flange and each pair of gussets, and said flaps attaching interiorly to the carton just below the side wall top edges.

2. The carton of claim 1 including a lid integrally foldably connecting to the upper edge of the back wall, said lid having a closure flap at its opposite edge, and said closure flap and its lid cooperating with the front wall to secure the scoop flange and the carton into closure.

3. The carton of claim 1 including fastening means, said fastening means securing each pair of gussets to their proximate side walls proximate the upper edge of the carton.

4. By The carton of claim 3 wherein said fastening means includes said side walls having at least one slit provided therein, each pair of gussets having a downwardly extending tab, and said tab of each pair of gussets securing within a side wall slit.

5. The carton of claim 2 including a lateral flap extending from each side of said lid, said lateral flaps being bent back adjacent to the side walls to hold the lid in an opened position when said scoop flange is arranged into an operative position.

6. The carton of claim 2 including a side flange extending from the upper edge of each side wall, and said side flanges capable of being folded over to aid in holding the scoop flange and its gussets into closure.

7. The carton of claim 1 and including a handle securing along the approximate height of one of the side, front, and back walls, said handle useful for holding of the carton when laden with pet litter.

* * * * *

UNITED STATES PATENT AND TRADEMARK OFFICE

CERTIFICATE OF CORRECTION

PATENT NO. : 5,829,671

DATED : November 3, 1998

INVENTOR(S) : Richard B. Hawk

It is certified that error appears in the above-indentified patent and that said Letters Patent is hereby corrected as shown below:

Column 6, claim 4, line 20, delete "By".

Signed and Sealed this

Second Day of March, 1999

*Attest:*

*Attesting Officer*

Q. TODD DICKINSON

*Acting Commissioner of Patents and Trademarks*